US011549774B2

(12) United States Patent
Shane et al.

(10) Patent No.: US 11,549,774 B2
(45) Date of Patent: Jan. 10, 2023

(54) APPARATUS AND METHOD FOR FIREARM OPERATIONS

(71) Applicant: Minuteman Defense, LLC, Overland Park, KS (US)

(72) Inventors: Scott D. Shane, Louisburg, KS (US); Kris W. Kobach, Piper, KS (US); Beverly J. Shane, Louisburg, KS (US)

(73) Assignee: Minuteman Defense, LLC, Overland Park, KS (US)

( * ) Notice: Subject to any disclaimer, the term of this patent is extended or adjusted under 35 U.S.C. 154(b) by 234 days.

(21) Appl. No.: 16/357,145

(22) Filed: Mar. 18, 2019

(65) Prior Publication Data

US 2019/0316864 A1 Oct. 17, 2019

Related U.S. Application Data

(60) Provisional application No. 62/644,034, filed on Mar. 16, 2018.

(51) Int. Cl.

| | |
|---|---|
| ***F41A 21/36*** | (2006.01) |
| ***F41A 3/66*** | (2006.01) |
| ***F41A 21/32*** | (2006.01) |

(52) U.S. Cl.

CPC ..... *F41A 21/36* (2013.01); *F41A 3/66* (2013.01); *F41A 21/325* (2013.01)

(58) Field of Classification Search

CPC ..... F41A 21/36; F41A 3/66; F41A 21/325

USPC ..... 89/14.2, 14.3

See application file for complete search history.

(56) References Cited

U.S. PATENT DOCUMENTS

| | | | | | |
|---|---|---|---|---|---|
| 2,101,850 | A * | 12/1937 | Green | F41A 21/36 | 89/14.3 |
| 2,150,161 | A * | 3/1939 | Green | F41A 21/34 | 89/14.3 |
| 2,165,457 | A * | 7/1939 | Cutts, Jr. | F41A 21/36 | 89/14.3 |
| 3,409,232 | A * | 11/1968 | Cholin | A62C 13/006 | 89/14.3 |
| 5,367,940 | A * | 11/1994 | Taylor | F41A 21/36 | 89/14.3 |
| 5,814,757 | A * | 9/1998 | Buss | F41A 21/36 | 89/14.3 |
| 9,134,084 | B1 * | 9/2015 | Harrison | F41A 21/36 | |

OTHER PUBLICATIONS

Military Spec Sheet for MIL-C-26074D (Year: 1989).*

Advance Plating Technologies published website profiling Electroless Nickel Plating conforming to MIL-C-26074D (Year: 2021).*

* cited by examiner

*Primary Examiner* — Samir Abdosh

(74) *Attorney, Agent, or Firm* — Avek IP, LLC

(57) ABSTRACT

A compensator device for manipulating and reducing the effects of firearm muzzle lift and a lower receiver for manipulating environmental effects on firearms and firearm operators.

11 Claims, 7 Drawing Sheets

APPARATUS AND METHOD FOR FIREARM OPERATIONS

CROSS-REFERENCE TO RELATED APPLICATION

This application claims the benefit of application Ser. No. 62/644,034, filed Mar. 16, 2018, entitled APPARATUS AND METHOD FOR FIREARM OPERATIONS.

FIELD

The present disclosure relates to firearm operations, and more specifically to a compensator device and method for manipulating and reducing the effects of firearm muzzle lift and a lower receiver for manipulating environmental effects on firearms and firearm operators.

BACKGROUND

In firearm operations, various factors and phenomena affect use of firearms in a negative way. When a projectile is propelled out of a firearm, gases expand and various phenomena are produced. One phenomenon is referred to as recoil. Recoil is typically produced by gas expanding against an inner wall located near a rear end of the farm, producing a rearward force on the firearm which in turn produces a force on the firearm operator or the mounting mechanism on which the firearm is deployed.

Another phenomenon that propelling a projectile out of a firearm may produce is muzzle lift. Muzzle lift is typically produced by expanding gases exerting forces on various parts of a firearm causing the forward end of the firearm, typically referred to as the muzzle, to lift with respect to its position before the projectile was launched. When a firearm requires more energy to propel a projectile or when projectiles are launched in rapid succession, the effects of muzzle lift are typically intensified. Muzzle lift can affect the accuracy of a firearm because it becomes more difficult to keep the muzzle aimed at a single vertical location throughout multiple firings. The muzzle may rise to the extent that the firearm blocks an operator's sight or a target the operator was aiming at. An operator's sight may further be blocked by gases exiting near a forward end of the firearm. Muzzle lift may fatigue an operator as a result of the operator making constant efforts to keep the muzzle at a single vertical location after each projectile firing.

Expanding gases may also carry agents such as dust and gunpowder to various parts of the firearm, resulting in maintenance problems in terms of both having to take apart the firearm to clean more frequently and causing parts to wear out or fail more quickly. One example is when expanding gases cause dust or gunpowder to enter the threads of a firearm part, causing the part to wear out or the operator to disassemble and clean the part sooner than expected. Such phenomena not only interfere with the effective and efficient use of a firearm but also cause an operator or manufacturer to alter desired firearm design and specifications. For example, muzzle lift effects may cause an operator to dispose more mass along the barrel of a firearm causing increased weight, undesirable weight distribution, or increased cost.

Depending on what environment a firearm is in, conditions may hamper the effective use of the firearm. Conditions may in certain circumstances be a matter of self-preservation for a firearm operator.

In situations where a firearm or firearm operator is spatially restricted it becomes more difficult for the operator to effectively use and maneuver the firearm. The operator may find it more difficult in terms of how quickly and comfortably the operator can raise or lower the firearm. The weight of the firearm and distribution of such weight may increase the difficulty of handling a firearm. An operator may have to locate a support point along the barrel, thereby causing discomfort or a need for support components. Depending on firearm design and firearm surroundings, an operator will often have to support the firearm at a location near the lower receiver, causing operator discomfort or an increased probability of interfering with an installed magazine by displacing the magazine and risking malfunction. Such diverse support requirements sometimes require additional firearm components, possibly resulting in increased cost and firearm weight. The increased weight may lead to discomfort or fatigue for the operator or support mechanism.

Operational conditions may require an operator to exchange the magazine in a lower receiver under less than ideal circumstances in order to reload the firearm. An operator may have to exchange the magazine using only one exchange mechanism, such as an arm, or exchange the magazine without being able to see the firearm which carries with it increased difficulty and possibly increased reload time. Such circumstances may also cause an operator to dispose a magazine in a firearm so that the firearm malfunctions or otherwise interferes with operational efficiency.

An operator often will need to place more than one support point on the firearm in order to effectively and comfortable operate it. In certain situations, firearm design will require an operator to remove one support point from the firearm, such as to retrieve or display an object from a location not on the firearm. Removing a support point can interfere with firearm operations in numerous ways, including distracting the operator and displacing the muzzle of a firearm from a target.

The trigger of a firearm is essential to safe and effective firearm operations. However, certain operational conditions cause a trigger guard to interfere with effective use of a firearm. Certain trigger guards do not leave enough room for the trigger to be operated with precision when the operator is wearing gloves or has large fingers. Other trigger guards also require multiple components that result in increased assembly time, increased cleaning time, or increased cost for a firearm manufacture or operator. Many trigger guards, which are constructed of breakable plastic material, or attached with thin and breakable pins, may break or become dislodged, thereby exposing the trigger and increasing the risk of accidental discharge of the firearm.

Therefore, it is desirable to provide a lower receiver device for firearm operations that remedies or prevents effects resulting from the various operational conditions a firearm will encounter throughout its life.

DETAILED DESCRIPTION

In the detailed description of the embodiments, like numerals are employed to designate like parts throughout. Various items of equipment such as fastening tools, washers, fasteners, bolts, screws, etc., may be omitted to simplify the description. However, those skilled in the art will realize that such conventional equipment may be employed as desired. The various components and embodiments illustrated throughout may be produced by conventional methods known to those skilled in the art such as casting, forging, machining, etc. The various embodiments and components illustrated may also be coated with electroless nickel coating to increase durability.

The present disclosure provides a compensator apparatus and method for use in firearm operations. Various aspects of the present disclosure minimize the effects flowing from the expanding gases of a firearm. One aspect of the present disclosure reduces the effect of muzzle lift for each projectile fired. Another aspect of the disclosure reduces the effects of agents such as dust and gunpowder spreading throughout a firearm. Certain aspects of the disclosure also have the effect of reducing the recoil effects on a firearm.

Figure 1:
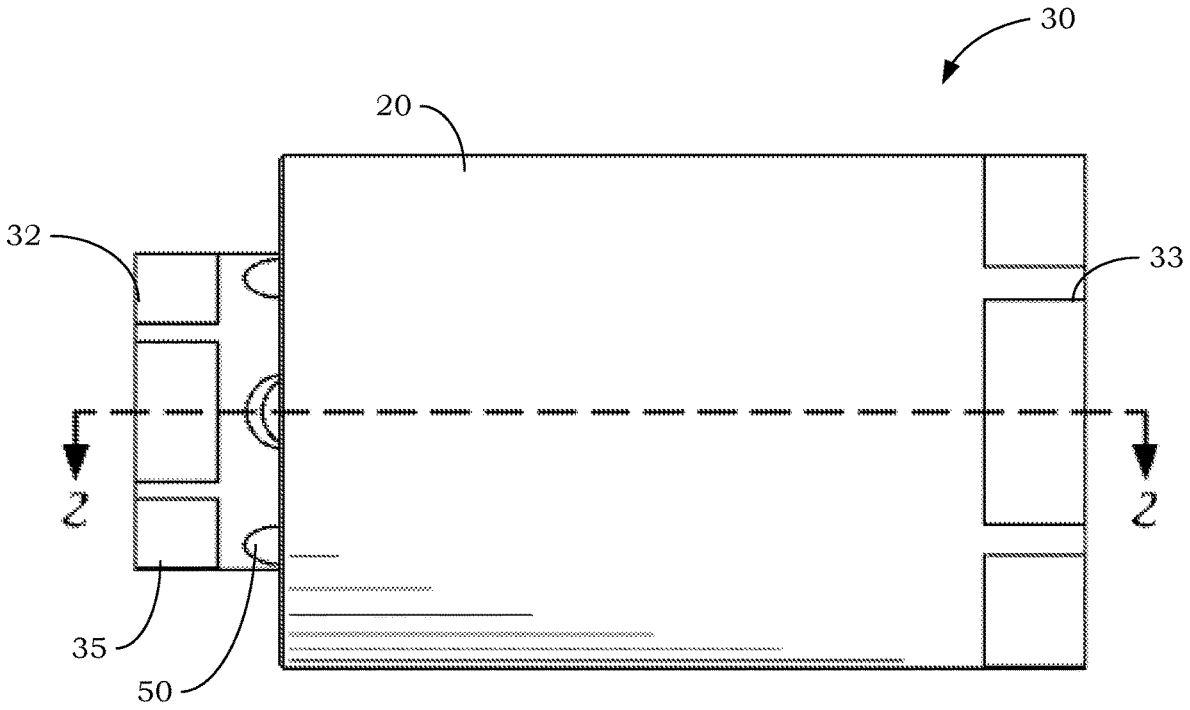
FIG. 1 is a side view illustrating an embodiment of a compensator apparatus.

The cylindrical member 31 shown includes a first end 32, a second end 33, an outer face 34, and a plurality 50 of apertures disposed on the cylindrical member 31. The embodiment illustrated also includes a forward cap 35 disposed near the first end 32 of the cylindrical member 31. Depending on operational needs those skilled in the art may choose to modify the compensator 30 so that the forward cap 35 and cylindrical member 31 are one integral piece or so that they make up multiple components of the compensator 30. The forward cap 35 or cylindrical member 31 may be modified so the compensator 30 may interact with various fastening tools. One way to achieve this is to make the forward cap 35 a hexagonal shape. The compensator 30 defines a compensator centerline axis X-X which passes linearly through the center of the cross-section of the compensator 30. The compensator 30 illustrated further includes a flange 40 disposed on the outer face 34 for protecting parts of the compensator or parts of a firearm used in conjunction with the compensator 30, as will be discussed later. A portion of the outer face 34 of the cylindrical member 31 may be threaded, as in the embodiment shown, for attachment to various firearm parts. Those of ordinary skill may recognize that other known conventional methods may be used to attach the compensator 30 to various firearm parts. In the embodiment illustrated in FIG. 1 there are a total of thirty apertures in the plurality 50 of apertures.

A portion of an inner face 36 may be threaded, as in the embodiment shown, for attachment to firearm components, however those skilled in the art may recognize other methods of attachment. Each aperture in the plurality 50 defines an aperture centerline axis 51 passing linearly through the center of the cross-section of the relevant aperture. The aperture centerline axis 51 of each relevant aperture extends linearly to intersect the compensator centerline axis X-X, acting incidentally to form an angle of incidence between the aperture centerline axis 51 and the compensator centerline axis X-X. The angle of incidence of each aperture represents an aperture angle θ for each aperture of the plurality 50. Each normal N represents the line intersecting the compensator centerline axis X-X for each aperture to measure its angle of incidence.

Figure 2:
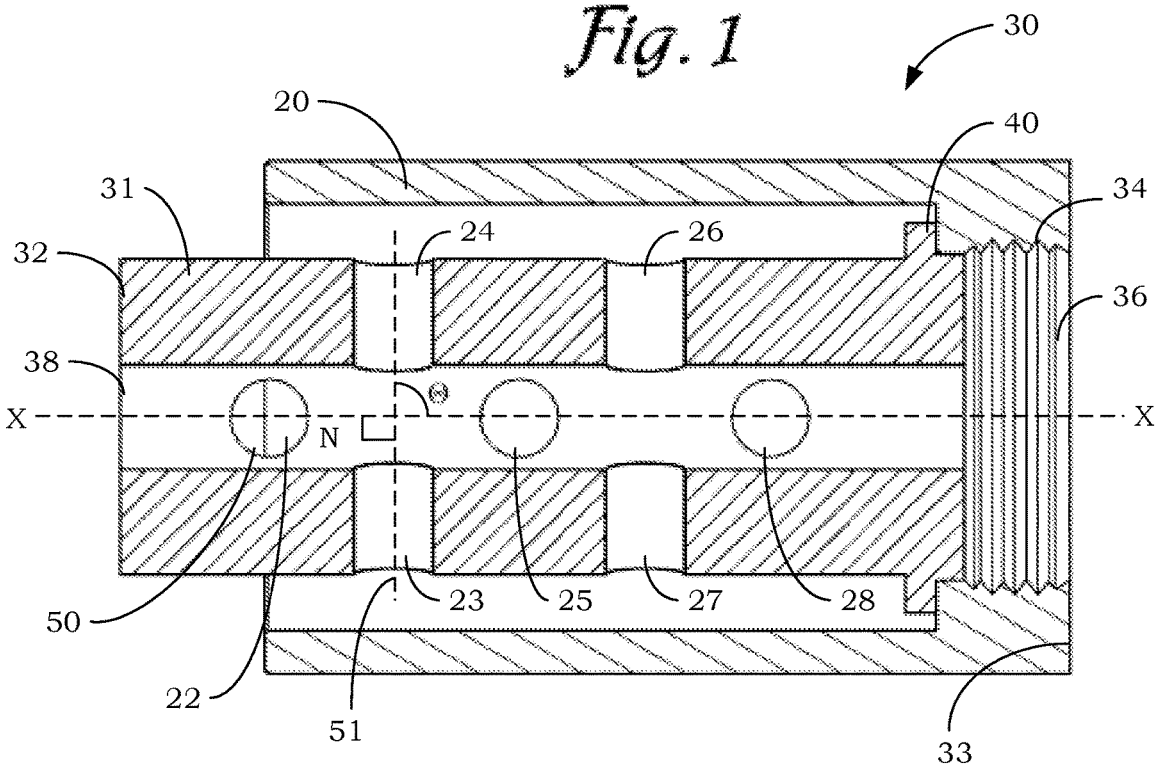
FIG. 2 is a side view illustrating an embodiment of the compensator apparatus of FIG. 1 with an emphasis on the plurality of apertures and an emphasis on the inside of the compensator apparatus.
Figure 3:
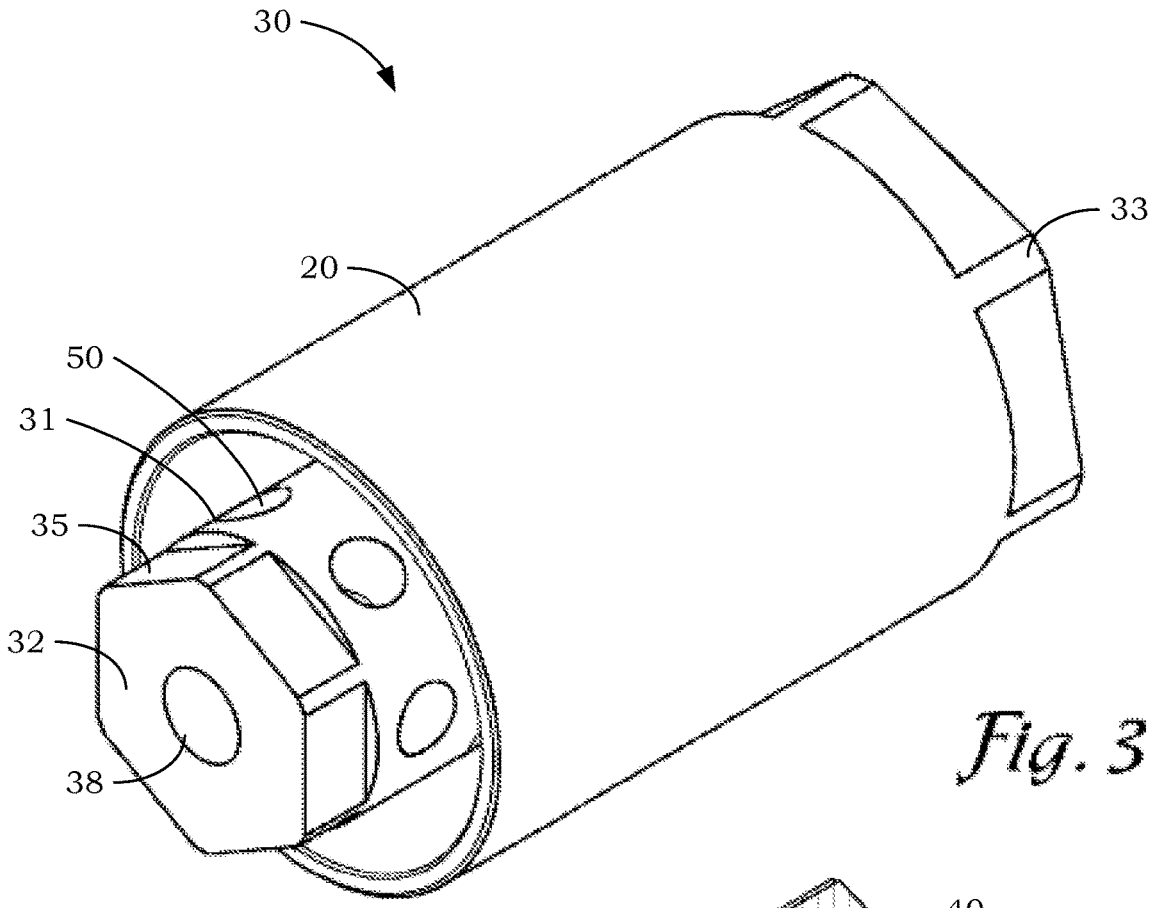
FIG. 3 is a perspective view illustrating an embodiment of a shielded compensator apparatus.
Figure 4:
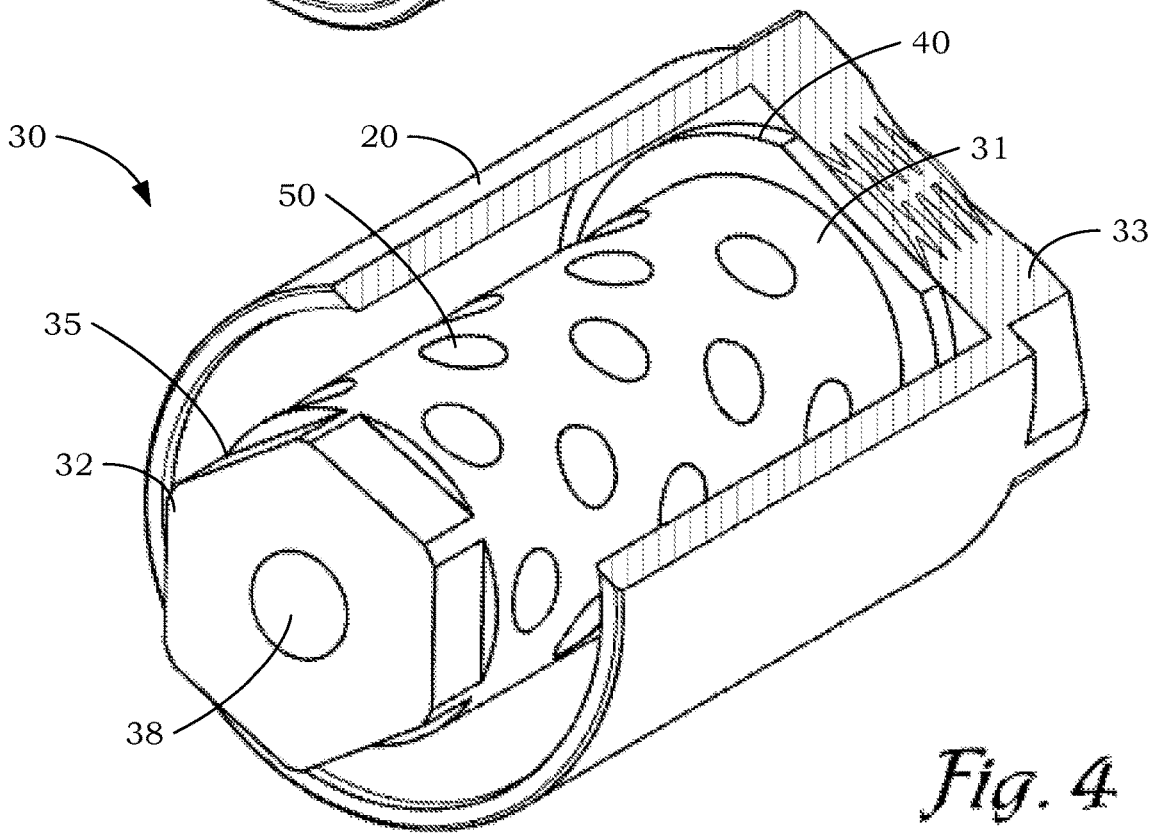
FIG. 4 is a partial cut-away view of the apparatus of FIG. 3.
Figure 5:
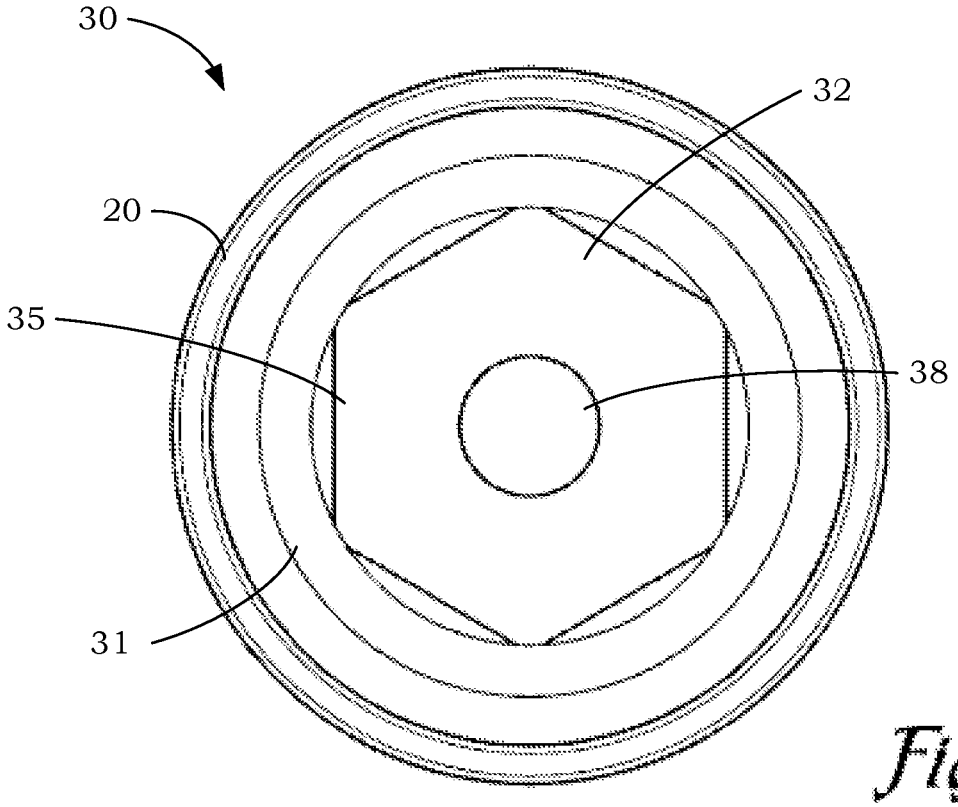
FIG. 5 is a front view illustrating an embodiment of the shielded compensator apparatus of FIG. 3.
Figure 6:
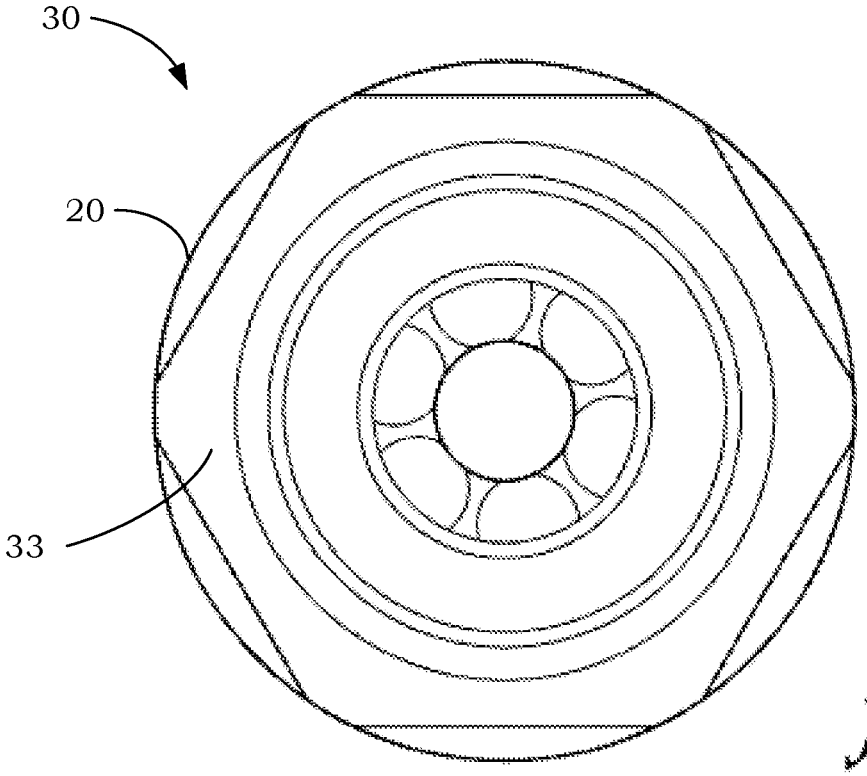
FIG. 6 is a side view illustrating an embodiment of a compensator embodiment installed on a firearm frame embodiment.

Those skilled in the art may modify the total number of apertures in the plurality 50, the size of each aperture in the plurality 50, the location of each aperture in the plurality, and the shape of aperture in the plurality 50 depending on operational needs. When a projectile is fired from a firearm, the plurality 50 of apertures allows for expanding gases to exit the compensator 30 which may manipulate the forces acting on the firearm and thereby reduce the effects of muzzle lift. There is also a reduction in firearm recoil achieved by allowing expanding gases to escape the compensator 30. The aperture angle θ predominates with respect to how the plurality 50 of apertures affects the compensator 30 function. The present disclosure asserts that optimal results for the compensator 30 reducing the effects of muzzle lift are achieved when each aperture in the plurality is disposed so that the aperture angle θ for each aperture is approximately nine degrees. As illustrated in the compensator 30 of FIG. 2, each aperture of the plurality 50 is disposed at an aperture angle θ of approximately nine degrees. Those skilled in the art may dispose more apertures on the cylindrical member 31 in addition to the plurality 50 and some of the additional apertures may be disposed at an aperture angle that is not equal to about nine degrees.

Compensator 30 may include a shield 20 disposed around the compensator 30. The compensator 30 and the shield 20 may be joined by conventional methods known to those skilled in the art, one of which may be threading. Depending on the various needs of those skilled in the art, the compensator 30 may be used with or without the shield 20. The shield 20 may be installed on the compensator 30 to further reduce the effects of muzzle lift, to prevent expanding gases exiting out of the compensator 30 from exiting rearward toward the operator, and to reduce the noise level of the firearm's discharge from the operator's perspective. The compensator 30 defines a compensator centerline axis X-X which passes linearly through the center of the cross-section of the compensator 30. Embodiments of the compensator 30 typically include a first aperture 312 for allowing a projectile to pass through located on the forward cap 35. The compensator 30 shown also includes a second aperture 22, a third aperture 23, a fourth aperture 24, a fifth aperture 25, a sixth aperture 26, and a seventh aperture 27 and an eighth aperture 28 for allowing expanding gas to pass through. Allowing expanding gases to pass through one or more of apertures 22-28 assists in reducing effects of muzzle lift by manipulating forces acting on the compensator 30 or a firearm which the compensator 30 is disposed on. Although the embodiment shown illustrates seven total apertures 22-28 in addition to the first aperture 38, those skilled in the art may modify the compensator 30 to include more or less apertures for allowing expanding gas to pass through. Those skilled in the art may also modify the size or geometric arrangement of apertures 22-28 depending on operational needs. The second aperture 22 illustrated defines a second aperture centerline which passes linearly through the center of the cross-section of the second aperture 22.

Figure 7:
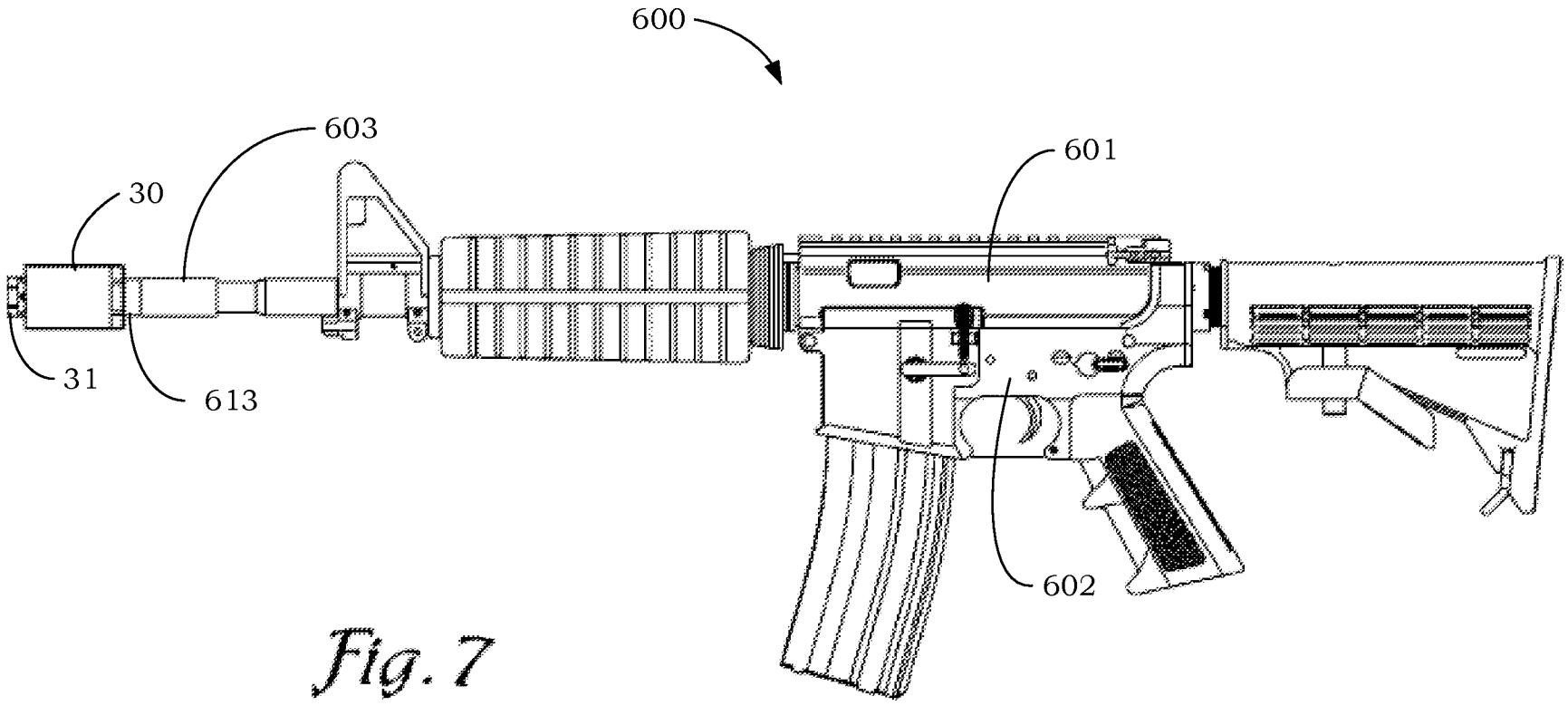
FIG. 7 is a side view illustrating an embodiment of a shielded compensator apparatus installed on a firearm frame embodiment.
Figure 8:
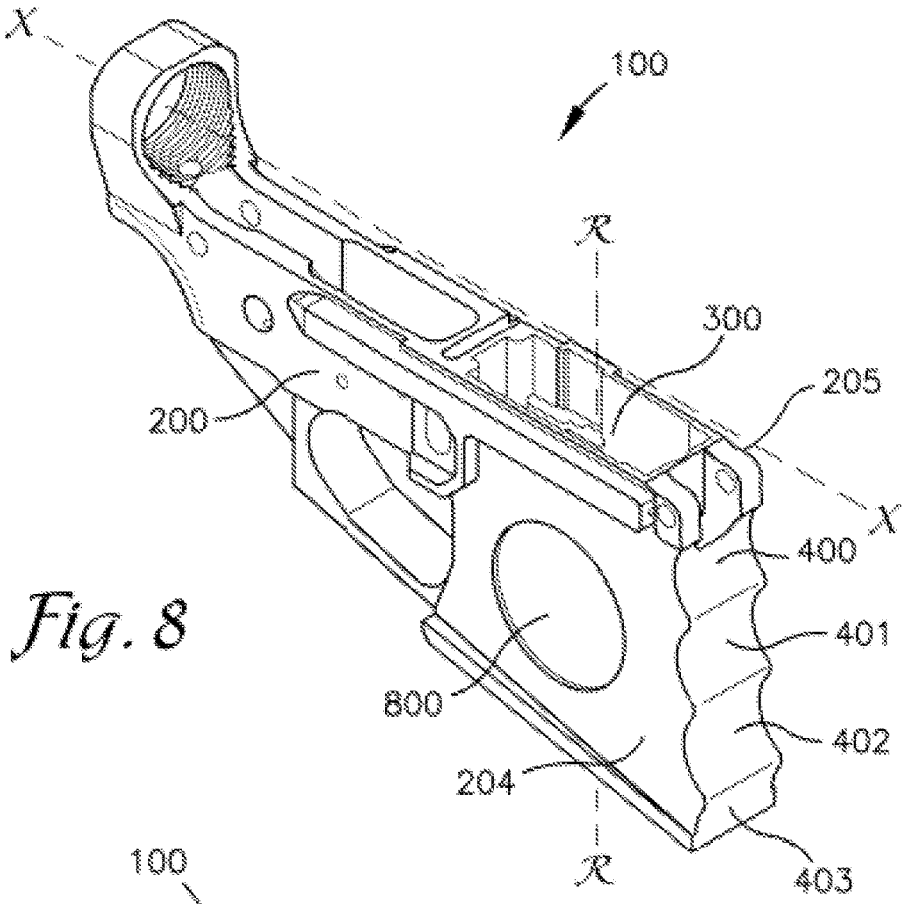
FIG. 8 is a perspective view illustrating an embodiment of a lower receiver apparatus.
Figure 9:
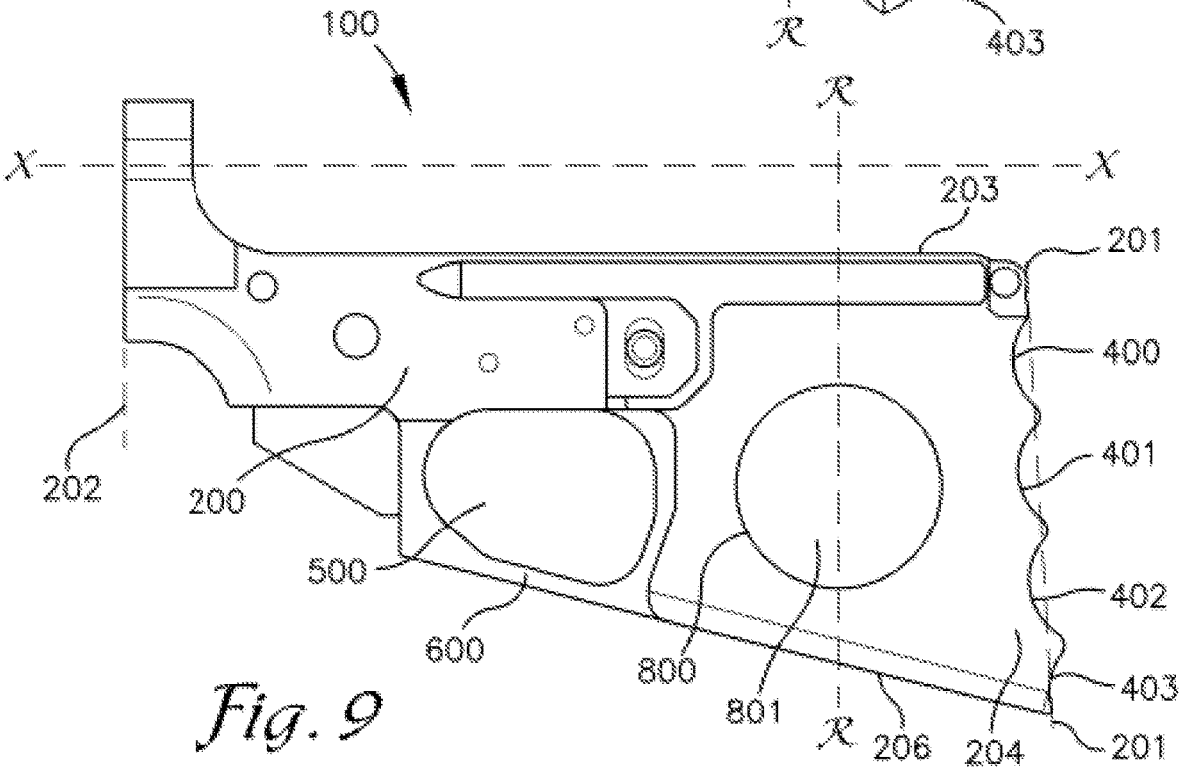
FIG. 9 is a-side view illustrating the lower receiver apparatus embodiment of FIG. 8.

Referring to FIG. 7, the compensator 30 may be disposed on a firearm frame 600. The compensator 30 illustrated is disposed on the firearm frame 600 at a location near the second end 33 of the cylindrical member 31. The firearm frame 600 illustrated includes a barrel 603 attached to the compensator 30, an upper receiver 601 disposed near the barrel 603, and a lower receiver 602 attached to the upper receiver 601. Those of ordinary skill will appreciate that the compensator 30 and the firearm frame 600 may be joined by conventional methods, including but not limited to: threading or making the firearm frame 600 and the barrel 603 one integral piece. The embodiment shown illustrates the compensator 30 attached to the firearm frame 600 near a first end 613 of the barrel 603

Those of ordinary skill may modify or combine the various embodiments of the compensator to be used in accordance with each other by combining or omitting various features described therein along with other with features readily known.

A method for producing various embodiments of a compensator apparatus is described below, the steps of which may not need to be performed in any specific order due to operational needs recognizable by an operator or manufacturer. Certain steps of method may, due to the needs of those skilled in the art, not need to be performed at all. Steps of method may be performed by production methods readily known, including but not limited to forging, casting, and machining. A compensator is provided, which may be performed by providing a cylindrical member, where the cylindrical member has two ends, and providing a forward cap where the forward cap may be disposed near one of the two ends of the cylindrical member. Apertures may also be provided on the forward cap. The step of providing a compensator may include conventional manufacturing methods such casting, forging, or machining. A plurality of apertures is provided on the compensator where each aperture is disposed at an aperture angle of about nine degrees, the aperture angle measuring the angle of incidence between a compensator centerline axis and an aperture centerline axis of the relevant aperture. A shield may be provided around the compensator and a flange may be provided between the compensator and the shield. The compensator may be attached to a firearm or a firearm frame. If present, a shield may be attached to a firearm or firearm frame. Any of the steps may be merged into a single step. For example, a single production step of casting may produce a compensator with apertures disposed at an aperture angle of about nine degrees, thereby embodying the steps above.

Thus a compensator apparatus and method for producing a compensator apparatus have been described.

In the detailed description of the embodiments, like numerals are employed to designate like parts throughout. Various items of equipment such as fastening tools, washers, fasteners, bolts, screws, etc., may be omitted to simplify the description. However, those skilled in the art will realize that such conventional equipment may be employed as desired. The various components and embodiments illustrated throughout may be produced by conventional methods known to those skilled in the art such as casting, forging, machining, etc. The various embodiments and components illustrated may also be coated with electroless nickel coating to increase durability.

The present disclosure provides a lower receiver apparatus and method for use in firearm operations. Various aspects of the present disclosure minimize the negative effects caused by the various operational conditions a firearm will face throughout its life. Certain embodiments include one more grooves on a lower receiver to effectuate support of the firearm under variable conditions. Some embodiments include a magazine well in a lower receiver to effectuate efficient magazine exchange in undesirable conditions. An integrated trigger guard is included with a lower receiver in some embodiments to effectuate efficient operation of a trigger and efficient production of a firearm. A lower receiver includes a recess in certain embodiments in order to reduce the probability of an operator removing a support point under variable operational conditions.

Referring now to FIGS. 8-12, a lower receiver 100 embodiment is illustrated, including a frame 200 and a magazine well passageway 300 disposed in the frame 200. The frame 200 includes a first external face 204 and a second external face 205 disposed on the opposite side of the magazine well passageway 300 from the first external face 204. The frame 200 further includes a recess 800 for disposition of displays objects such as challenge coins and badges, which will be discussed further at subsequent parts of the present disclosure. The frame 200 further includes a first groove 400, a second groove 401, a third groove 402, and a fourth groove 403. Grooves 400-402 will be further discussed. The frame 200 may be a single integral piece in various embodiments. A muzzle trajectory line X-X and a reference line R-R that intersects perpendicularly the muzzle trajectory line X-X, which will be further discussed at subsequent parts of the present disclosure.

Figure 10:
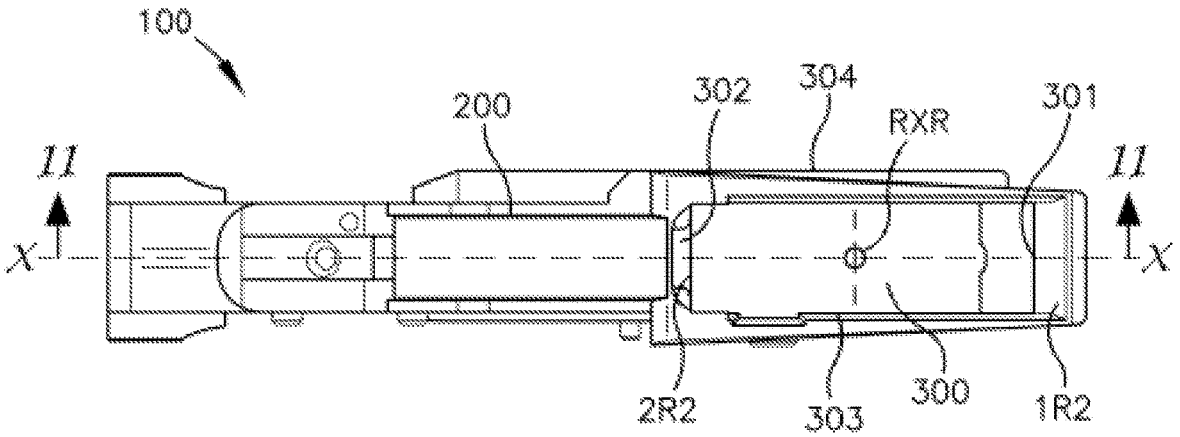
FIG. 10 is a bottom view illustrating the lower receiver apparatus embodiment of FIG. 8.
Figure 11:
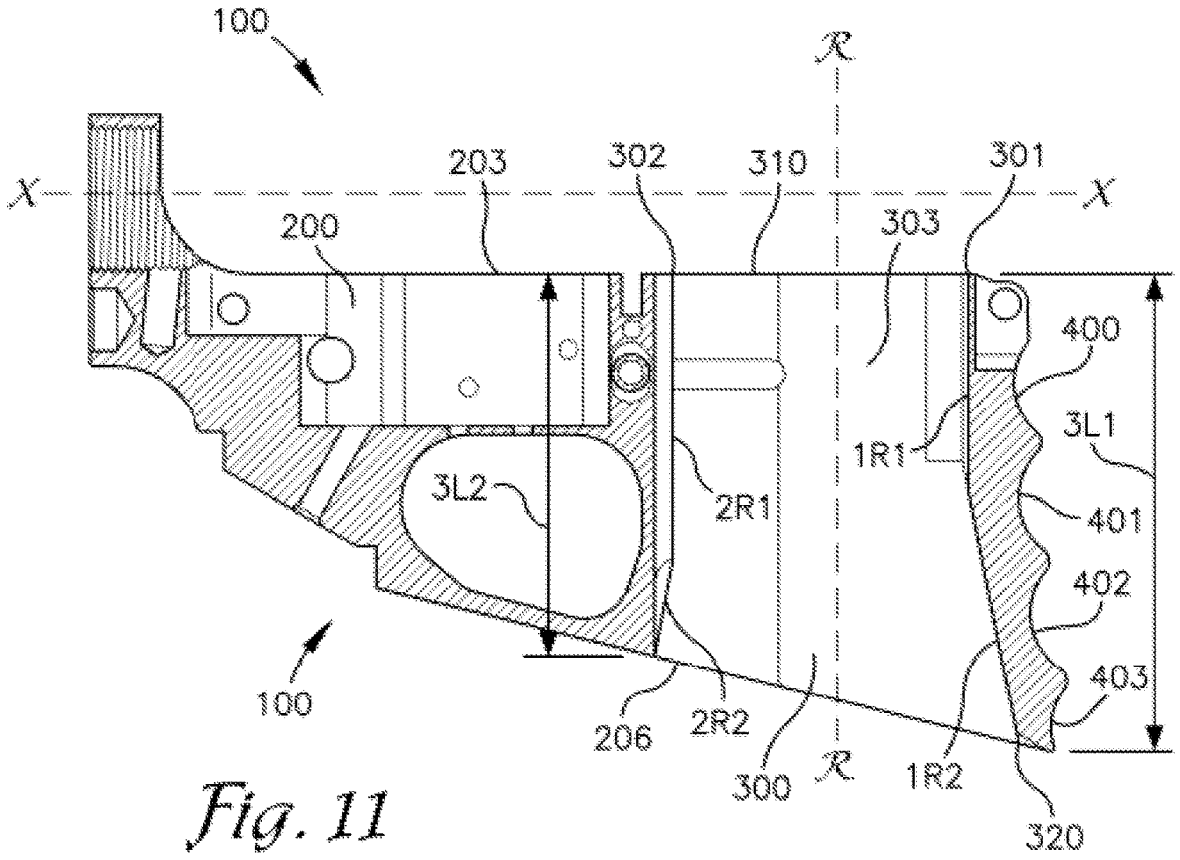
FIG. 11 is a cut-away view illustrating the lower receiver apparatus embodiment of FIG. 8.
Figure 12:
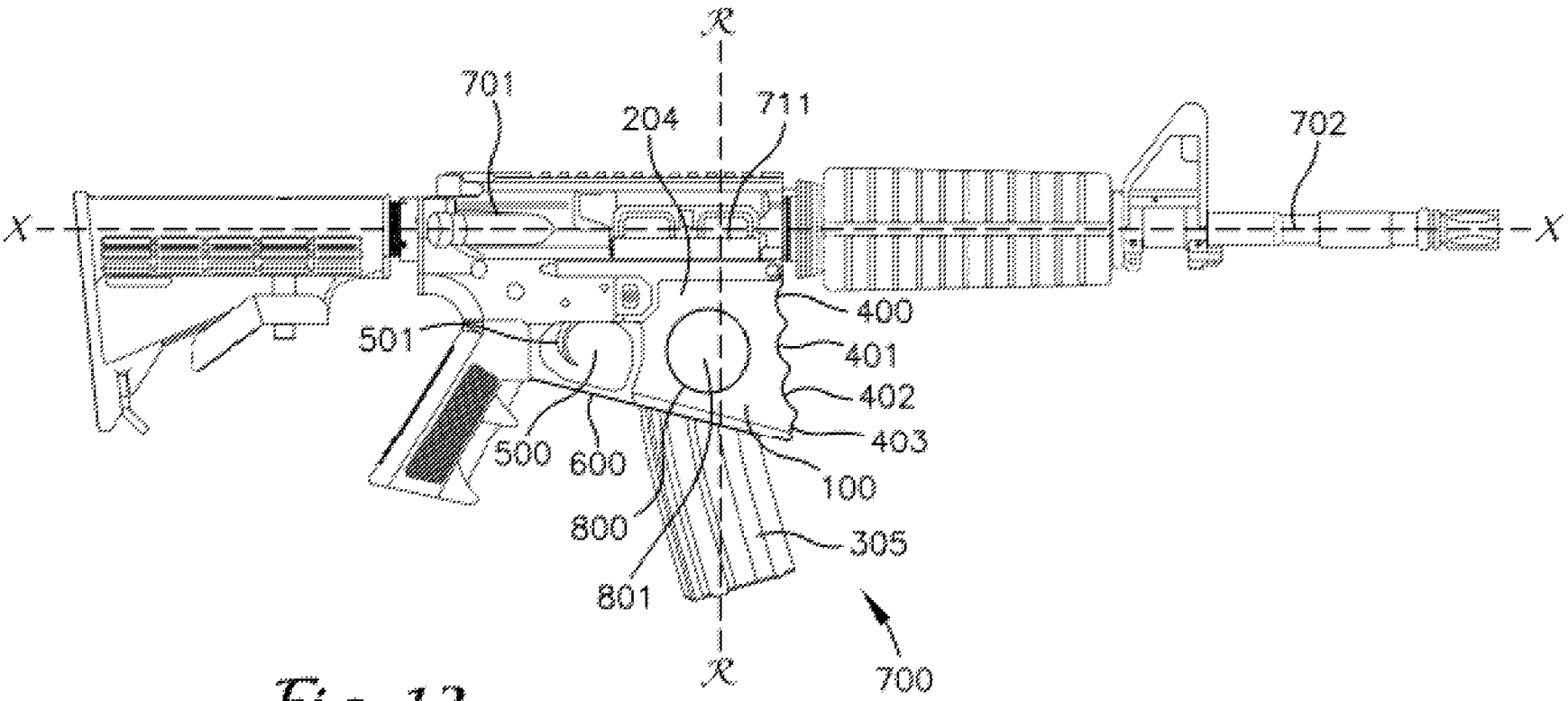
FIG. 12 is a side view illustrating an embodiment of a lower receiver apparatus installed on a firearm embodiment.

A lower receiver 100 embodiment including a frame 200. The frame 200 includes a forward end 201, a rear end 202, a top end 203, and a bottom end 206. FIG. 10 further illustrates a first external face 204 of the frame 200. The frame 200 further includes a first groove 400, a second groove 401, a third groove 402, and a fourth groove 403.

A trigger slot 500 is disposed in the frame 200 for the operation of a trigger mechanism. A trigger guard 600 is disposed to define and cover the lower boundary of the trigger slot 500, thereby enclosing the trigger slot 500. In the particular embodiment illustrated the trigger guard 600 and the frame 200 are one integral piece, which allows for the trigger slot 500 to be larger due to the downward slope from the rear end of the trigger guard to the forward end of the trigger guard. The fact that the trigger guard and the frame 200 are one integral piece also greatly increases the strength and durability of the trigger guard, greatly reducing the risk that the trigger guard might become broken or dislodged. The fact that the trigger guard and the frame 200 are one integral piece also results in fewer pieces for an operator or manufacturer to assemble the lower receiver 100. The larger trigger slot 500 may allow for more efficient use of the trigger mechanism by meeting the need for larger operational mechanisms to pass through the trigger slot. An example of such need is when the operator has a glove of sufficient thickness to require a larger trigger slot. The reduction in total pieces required to assemble the lower receiver 100 may result in advantages such as decreased cost and decreased assembly time.

A frame 200 that includes a top end 203 and a bottom end 206. The frame 200 includes a magazine well passageway 300 disposed in the frame 200. The magazine well passageway 300 includes a proximal end 310 located near the top end 203 of the frame and a distal end 320 located near the bottom end 206 of the frame 200. The top end 310 of the frame 200 defines a muzzle trajectory line X-X that runs substantially parallel to the proximal end 203 of the magazine well passageway 300. The magazine well passageway 300 includes a forward face 301, a rear face 302, and a first side face 303. In the embodiment shown, the forward face 301 includes a first ramp section 1R1 that is substantially parallel to the reference line R-R and a second ramp section 1R2 that is oblique to the reference line R-R. The rear face 302 includes a first ramp section 2R1 that is substantially parallel to the reference line R-R and a second ramp section 2R2 that is oblique to the reference line R-R. Utilizing ramp sections oblique to the reference line R-R allows for a larger entry, located near the distal end 320, for inserting magazines into the magazine well passageway 300, thereby allowing more room for error when inserting a magazine without causing the firearm to malfunction due to an improper magazine insertion. An increased room for error is especially beneficial when an operator must exchange a magazine in harsh conditions, such as when the operator only has one functioning arm to perform the exchange or when the operator cannot see the firearm. Utilizing ramp sections oblique to the reference line R-R also allows for the ramp sections that are parallel to the reference line R-R to be closer to one another so that there is less looseness and movement when the magazine is fully inserted. Utilizing ramp sections parallel to the reference line R-R assists in ensuring that when magazines are inserted the projectiles are aligned properly with respect to the muzzle trajectory line X-X for proper function of a firearm.

The rear face 302 of the magazine well passageway 300 defines a rear length 3L2 measuring linearly from the proximal end 310 to the distal end 320 and the forward face 301 defines a forward length 3L1 also measuring linearly from the proximal end 310 to the distal end 320. In the embodiment shown the forward length 3L1 is longer than the rear length 3L2, which may allow greater variation in the dimensions and alignment of the ramp sections 1R1, 1R2, 2R1, and 2R2 in the magazine well passageway 300. A longer forward length 3L1, for example, may allow for a larger magazine entry that increases the room for error in magazine installation because the oblique ramp sections may be larger. A longer forward length 3L1 also gives an operator or manufacturer increased latitude in choosing how many, and the specifications of, one or more grooves 400-403 disposed on the frame 200.

Reference line centerpoint R-R marks the location of reference line R-R. A frame 200 includes a magazine well passageway 300. The magazine well passageway includes a forward face 301, a rear face 302, a first side face 303, and a second side face 304. A second ramp section 1R2 of the forward face 301 is oblique to the reference line R-R and a second ramp section 2R2 of the rear face 302 is oblique to the reference line R-R. Depending on operational needs any one of the forward face 301, the rear face 302, the first side face 303, and the second side face 304 may include a first ramp section substantially parallel to the reference line R-R and a second ramp section oblique to the reference line R-R in order to achieve the benefits thereof. However, in the embodiment illustrated only the forward face 301 and the rear face 302 include first ramp sections 1R1 and 2R1 substantially parallel to the reference line R-R and second ramp sections 1R2 and 2R2 oblique to the reference line. Depending on operational needs all the ramp sections of the forward face 301, the rear face 302, the first side face 303, and the second side face 304 may be modified in terms of length, angle, location, total number of oblique ramp sections, total number of parallel ramp sections, etc.

Any of the embodiments described above may be installed to form a firearm 700 embodiment including a lower receiver 100 attached to an upper receiver 701 and a barrel 702 attached to the upper receiver 701. The lower receiver 100 includes a frame 200 and the frame 200 includes a trigger slot 500, a trigger guard 600, and a trigger 501 disposed within the trigger slot 500. A magazine 305 loaded into the lower receiver 100 is also illustrated. It is usually desirable to align the lower receiver 100 so that projectiles loaded into the firearm 700 are launched along a path similar to the path defined by the muzzle trajectory line X-X.

A first groove 400, a second groove 401, a third groove 402, and a fourth groove 403 are illustrated. The grooves 400-403 constitute a comfortable support point for the operator that would otherwise likely be located along the barrel 702 or on the magazine 305. An additional option for a comfortable support point is beneficial because the varying operational conditions a firearm will experience throughout its life may cause an operator to change support point locations multiple times. By eliminating the possible need for a magazine 305 support point, the risk of firearm malfunction is reduced because the support force is no longer applied to the magazine 305 thereby reducing the risk that the magazine 305 will be displaced with respect to its position before the support force is applied. Reducing such a risk also may eliminate the need for additional components that reduce malfunction risk or prevent magazine 305 displacement. A support point near the grooves 400-403 also may eliminate the need to place a support point along the barrel 702. Doing so can reduce operator discomfort and may eliminate the need for additional components, such as a pistol grip, to be disposed along the barrel 702 to provide additional support points for the firearm 700. Removing the need for additional components may reduce cost, weight, or production time for firearms. In order to maximize operator comfort, those of ordinary skill may modify the grooves 400-403 to match the hand or support mechanism utilized by the operator. Those of ordinary skill may also decide to use less than, or more than, four total grooves depending on operational needs. Those of skill in the art will appreciate that the grooves 400-403 may be provided by a variety of readily known manufacturing techniques, including but not limited to machining. In certain circumstances the grooves may result in a reduction of weight of the lower receiver 100 because the grooves 400-403 may be provided by removing material of the frame 200.

A recess 800 is disposed on the frame 200 for insertion of a display object 801. The display object 801 may be a badge or a challenge coin embodying a graphic design, as in the embodiment shown. The display object 801 may be important to quickly identify the firearm 700 as the property of its owner or to identify the firearm and its operator as belonging to a specific law enforcement or military unit. Without a recess, an operator may otherwise need to remove a support point from the firearm 700 to effectively the display object 801. One example is the firearm operator may encounter a situation in which the operator needs to retrieve a display object 801, such as a badge or a challenge coin, from a pocket so that another may see the display object 801. By disposing the display object 801 on the frame 200 an operator may effectively show the display object 801 in directions desired without removing any support points from the firearm 700. The depth of the recess 800 may be of varying magnitude depending on the display object 801 disposed within it. In certain circumstances a wall thickness of the frame 200 may need to be modified to accommodate the required depth of the recess 800. The recess 800 may be disposed on a first external face 204 of the frame 200, as in the embodiment shown, or the recess may be disposed on a second external face 205 located on the opposite side of the magazine well passageway 300 from the first external face 204. In some circumstances the recess 800 may be disposed on an external face of the frame 200 that is nearest an ejection port 711 of the upper receiver 701 so that an operator does not effectively block the display object 801 during firearm operations.

Those of ordinary skill may modify or combine the various embodiments to be used in accordance with each other by combining or omitting various features or embodiments described therein along with other features or embodiments known.

A method for producing various embodiments of a lower receiver apparatus, the steps of which may not need to be performed in any specific order due to operational needs recognizable by an operator or manufacturer. A lower receiver is provided with a muzzle trajectory line and a reference line intersecting perpendicularly the muzzle trajectory line. A magazine well passageway is provided, where at least one face of the magazine well passageway includes a section substantially parallel to the reference line and a section oblique to the reference line. One or more grooves are provided on the lower receiver. A trigger slot is provided and a trigger guard is provided to combine with the lower receiver and form a single integral piece. A recess is provided and a display object, such as a challenge coin or badge, is provided. An upper receiver is provided, a barrel is provided, any of which may be provided in addition to the lower receiver to form a firearm embodiment. A magazine is provided, which may be disposed in the magazine well passageway.

Certain steps may, due to the needs of those skilled in the art, not need to be performed at all. The steps may be performed by conventional production methods readily known, including but not limited to casting, forging, and machining. Some of the steps in the method may be merged into a single step. For example, a single lower receiver may be produced by a single step of casting or machining that embodies all steps.

Thus a lower receiver apparatus and method for producing a lower receiver apparatus have been described. Embodiments described herein further relate to any one or more of the following paragraphs:

A lower receiver apparatus for firearms, comprising a lower receiver, wherein the lower receiver comprises a frame, the frame having a forward end, a rear end, a bottom end, and a top end, the top end of the frame defining a muzzle trajectory line and a reference line substantially perpendicular to the muzzle trajectory line; a magazine well passageway disposed within the frame, the magazine well passageway having a proximal end, a distal end, a forward face, a rear face, a first side face, and a second side face; and wherein at least one of the forward face, the rear face, the first side face, or the second side face of the magazine well passageway comprises: a first ramp section substantially parallel to the reference line, and a second ramp section oblique to the reference line.

While certain features and embodiments of the present disclosure have been described in detail herein, it will be readily understood that the present disclosure encompasses all modifications and enhancements within the scope and spirit of the following claims. Furthermore, no limitations are intended in the details of construction or design herein shown, other than as described in the claims below. Moreover, those skilled in the art will appreciate that description of various components and embodiments are not intended as limitations, but are provided for the convenience of describing the present disclosure.

Having thus described the invention, what is claimed as new and desired to be secured by Letters Patent is as follows:

1. A compensator apparatus for firearm operations, comprising:

a compensator having a cylindrical member, said cylindrical member defining a compensator centerline axis, said cylindrical member having a first end, a second end, an inner face, and an outer face; a plurality of two or more apertures disposed on the cylindrical member, each aperture of said plurality defining an aperture centerline axis extending linearly to said compensator centerline axis, and each aperture of said plurality defining an aperture angle measuring the angle of incidence between said aperture centerline axis and said compensator centerline axis; and wherein said aperture angle of each aperture in the plurality is canted rearward toward said second end of said cylindrical member from perpendicular to said compensator centerline axis;

wherein the compensator further comprising a forward cap disposed near said first end of said cylindrical member and having a first aperture for allowing a projectile to pass through the forward cap, and a second aperture defining a second aperture centerline axis;

wherein said forward cap further comprising a third aperture, a fourth aperture, a fifth aperture, a sixth aperture, and a seventh aperture.

2. The compensator apparatus of claim 1, wherein a portion of said inner face of said cylindrical member is threaded.

3. The compensator apparatus of claim 1, wherein a portion of said outer face of said cylindrical member is threaded.

4. The compensator apparatus of claim 1, wherein said plurality comprises thirty apertures.

5. The compensator apparatus of claim 1, wherein said second aperture is disposed so that said second aperture centerline axis is substantially parallel to said compensator centerline axis.

6. The compensator apparatus of claim 1, wherein said second aperture is disposed so that said second aperture centerline axis is oblique to said compensator centerline axis.

7. The compensator apparatus of claim 1, wherein said cylindrical member and said forward cap comprise an integral piece.

8. The compensator apparatus of claim 1, further comprising a firearm frame attached to said compensator.

9. The compensator apparatus of claim 8, wherein said firearm frame comprises a barrel having a first end and a second end, wherein said first end of said barrel is connected to said compensator, a lower receiver, and an upper receiver connected to said lower receiver.

10. The compensator apparatus of claim 1, further comprising a shield disposed around said compensator to cover a portion of said outer face of said cylindrical member, said shield defining an annulus between said compensator and said shield.

11. The compensator apparatus of claim 10, further comprising a flange disposed at least partially in said annulus between said compensator and said shield.

* * * * *